US007618166B1

(12) United States Patent
Truax et al.

(10) Patent No.: US 7,618,166 B1
(45) Date of Patent: Nov. 17, 2009

(54) LIGHT FIXTURE LAMP HOLDER AND MODULAR TRIM ASSEMBLY THEREFOR

(75) Inventors: Robert Truax, Sebastopol, CA (US); Joel Visser, Sebastopol, CA (US); Gary Cross, San Francisco, CA (US)

(73) Assignee: Number Eight Lighting Company, Sebastopol, CA (US)

( * ) Notice: Subject to any disclaimer, the term of this patent is extended or adjusted under 35 U.S.C. 154(b) by 0 days.

(21) Appl. No.: 12/176,277

(22) Filed: Jul. 18, 2008

Related U.S. Application Data

(60) Provisional application No. 60/950,436, filed on Jul. 18, 2008.

(51) Int. Cl.
*F21V 15/00* (2006.01)

(52) U.S. Cl. ..... 362/364; 362/269; 362/365; 362/371

(58) Field of Classification Search ..... 362/147, 362/148, 269, 275, 285, 362, 364, 365, 368, 362/372, 427, 428, 429
See application file for complete search history.

(56) References Cited

U.S. PATENT DOCUMENTS

| | | | | |
|---|---|---|---|---|
| 3,130,949 | A | 4/1964 | Erhardt et al. | |
| 3,609,338 | A | 9/1971 | Kripp | |
| 3,815,857 | A | 6/1974 | McFarlin | |
| 4,083,153 | A | 4/1978 | Sumpter | |
| 4,336,575 | A | 6/1982 | Gilman | |
| 4,703,406 | A | 10/1987 | Elliott et al. | |
| 5,083,248 | A | 1/1992 | Troy | |
| 5,588,737 | A | 12/1996 | Kusmer | |
| 6,082,878 | A | 7/2000 | Doubek et al. | |
| 6,471,374 | B1 * | 10/2002 | Thomas et al. | 362/285 |
| 6,474,846 | B1 | 11/2002 | Kelmelis | |
| 6,612,076 | B2 | 9/2003 | Jacksen | |
| 6,652,124 | B2 | 11/2003 | Schubert | |
| 6,957,896 | B2 | 10/2005 | Burgess | |
| 7,311,422 | B1 * | 12/2007 | Chen | 362/364 |
| 2003/0161153 | A1 | 8/2003 | Patti | |
| 2005/0183344 | A1 | 8/2005 | Ziobro et al. | |

* cited by examiner

*Primary Examiner*—Hargobind S Sawhney
(74) *Attorney, Agent, or Firm*—Craig M. Stainbrook; Stainbrook & Stainbrook, LLP

(57) ABSTRACT

A recessed lighting unit that includes an adjustable lamp holder assembly, a fixture housing within which the adjustable lamp holder assembly is mounted; and a modular trim assembly, wherein the adjustable lamp holder assembly includes a pivot bracket detachably mounted in the fixture housing with a bolt that may be loosed and tightened for selected rotatable adjustment about a horizontal plane, and a vertical portion with a gear knob having a shaft disposed through an arcuate gear knob slot, and operatively connected to spur gear in mesh with gear teeth on an arcuate portion of a lamp support bracket, such that rotation of the gear knob rotates the lamp support bracket in a vertical plane.

4 Claims, 16 Drawing Sheets

LIGHT FIXTURE LAMP HOLDER AND MODULAR TRIM ASSEMBLY THEREFOR

CROSS REFERENCES TO RELATED APPLICATIONS

The present application claims the benefit of the filing date of U.S. Provisional Patent Application Ser. No. 60/950,436, filed Jul. 18, 2007.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to lighting apparatus, and more particularly to recessed lighting fixtures, and still more particularly to an adjustable lamp holder assembly and modular trim system for recessed lighting.

2. Discussion of Related Art Including Information Disclosed under 37 CFR 001.97, 1.98

Adjustable light holders are known in the art. Apparatus known and improved upon by the present invention is shown in U.S. Pat. No. 6,652,124 to Schubert. This patent discloses a light fixture including a light fixture assembly and an angle adjustment assembly movably connected to the light fixture assembly so as to move rotationally relative to the fixture assembly and a rotation adjustment assembly movably connected to the angle adjustment so as to move angularly relative to the angle adjustment assembly and to maintain a fixed angle between the rotation adjustment assembly and the fixture assembly. The rotation adjustment assembly orients and fixes a lamp relative to the fixed angle and the rotation adjustment assembly maintains the fixed rotational orientation when the lamp is replaced with another lamp.

Additionally, trim assemblies for recessed lighting systems are well known. Exemplary patents and patent applications showing background art include U.S. Pat. No. 6,612,076, to Jackson, U.S. Pat. No. 6,957,896, to Burgess, and U.S. Pat. No. 6,474,846, to Kelmelis.

The '846 patent to Burgess teaches a recessed lighting aperture edging device for surrounding the periphery of an orifice formed in a ceiling or wall. It includes a perforated planar rim extending from a trim lip for covering with layer of settable material after installation to form a surface finish. A flange extends in the opposite direction from the lip for insertion into the orifice and defines an inner surface of the orifice which extends substantially orthogonally to said surface finish.

The '076, to Jacksen shows a porous flange device for mounting construction hardware or trims flush with the finish surface plane of a wall or ceiling. It includes a porous flange projection having a trim and an outer surface edge with an opening which surrounds and lies flush with the outer surface of the trim. The porous flange projection outer surface edge is porous and provides a guide for the setting material forming the surface finish.

The '846 to Kelmelis describes another exemplary flush trim collar assembly.

Other background trim assemblies of note include: Patent Application Serial No. 2003/0161153, by Patti, which teaches a ceiling light with a square bezel or trim that has multiple holes. Patent Application Serial No. 2005/0183344, by Ziobro et al, teaches a circular mud ring with holes for a ceiling opening. U.S. Pat. No. 6,612,076, to Jacksen, teaches a porous square flange for a ceiling light. Other module trim assemblies for recessed lighting systems are shown in the following U.S. Pat. Nos. 4,083,153 to Sumpter; 3,130,949, to Erhardt, et al; 6,082,878, to Doubek et al; 5,588,737 to Kusmer; 3,609,338, to Kripp; 5,083,248, to Troy; 4,336,575, to Gilman; 3,815,857 to McFarlin; and 4,703,406, to Elliott et al.

The foregoing patents reflect the current state of the art of which the present inventors are aware. Reference to, and discussion of, these patents is intended to aid in discharging Applicants' acknowledged duties of candor in disclosing information that may be relevant to the examination of claims to the present invention. However, it is respectfully submitted that none of the above-indicated patents disclose, teach, suggest, show, or otherwise render obvious, either singly or when considered in combination, the invention described herein.

BRIEF DESCRIPTION OF THE SEVERAL VIEWS OF THE DRAWINGS

The invention will be understood, and the objects and advantages of the invention will be apparent when consideration is given to the following detailed description thereof. Such description makes reference to the annexed drawings wherein:

FIG. 5A is a lower exploded perspective view of a flush, square trim assembly for installation in surfaces having a plaster finish, while

DETAILED DESCRIPTION OF THE INVENTION

Figure 1A:
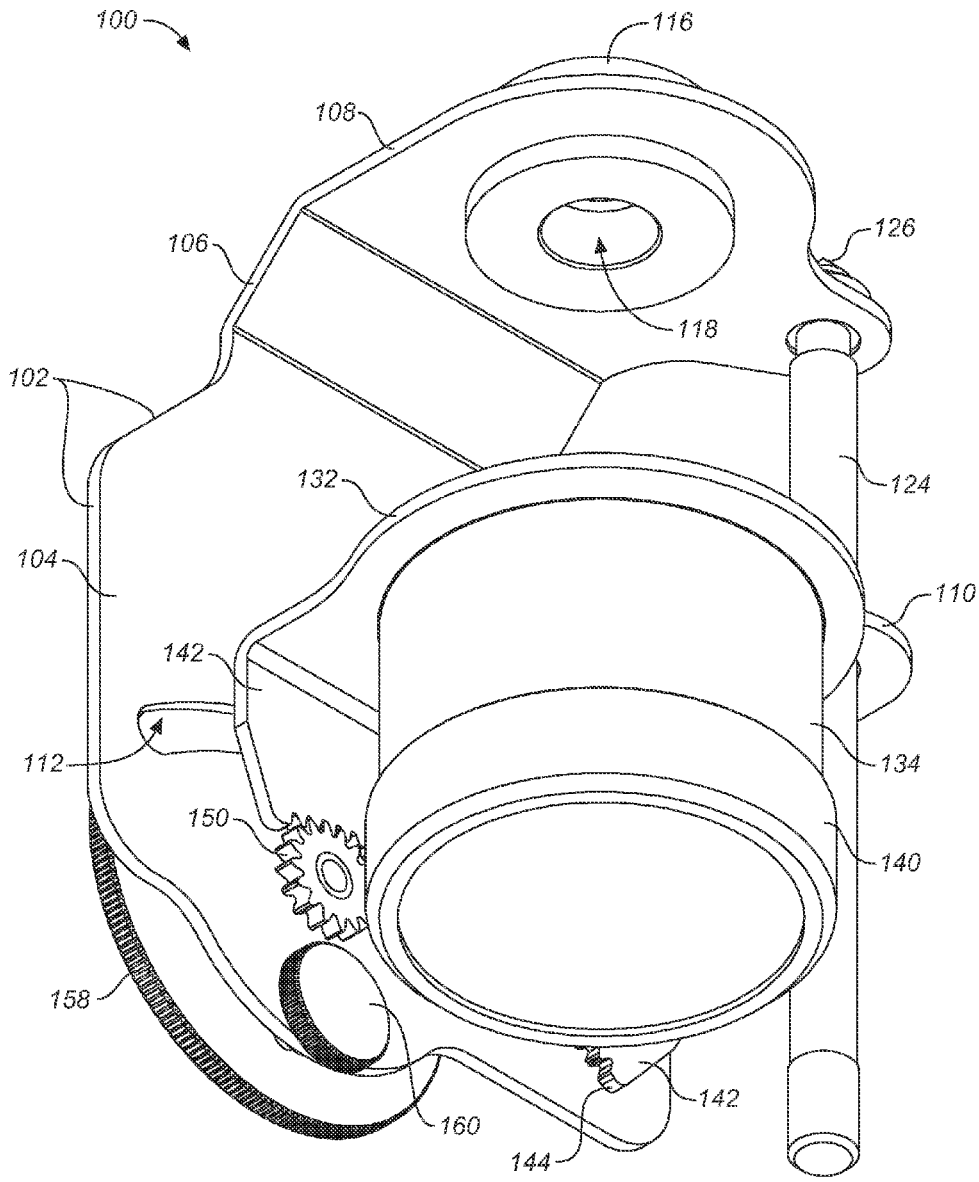
FIG. 1A is a lower front right perspective view of the adjustable lamp holder assembly of the present invention, showing a lamp held in a neutral position.
Figure 1B:
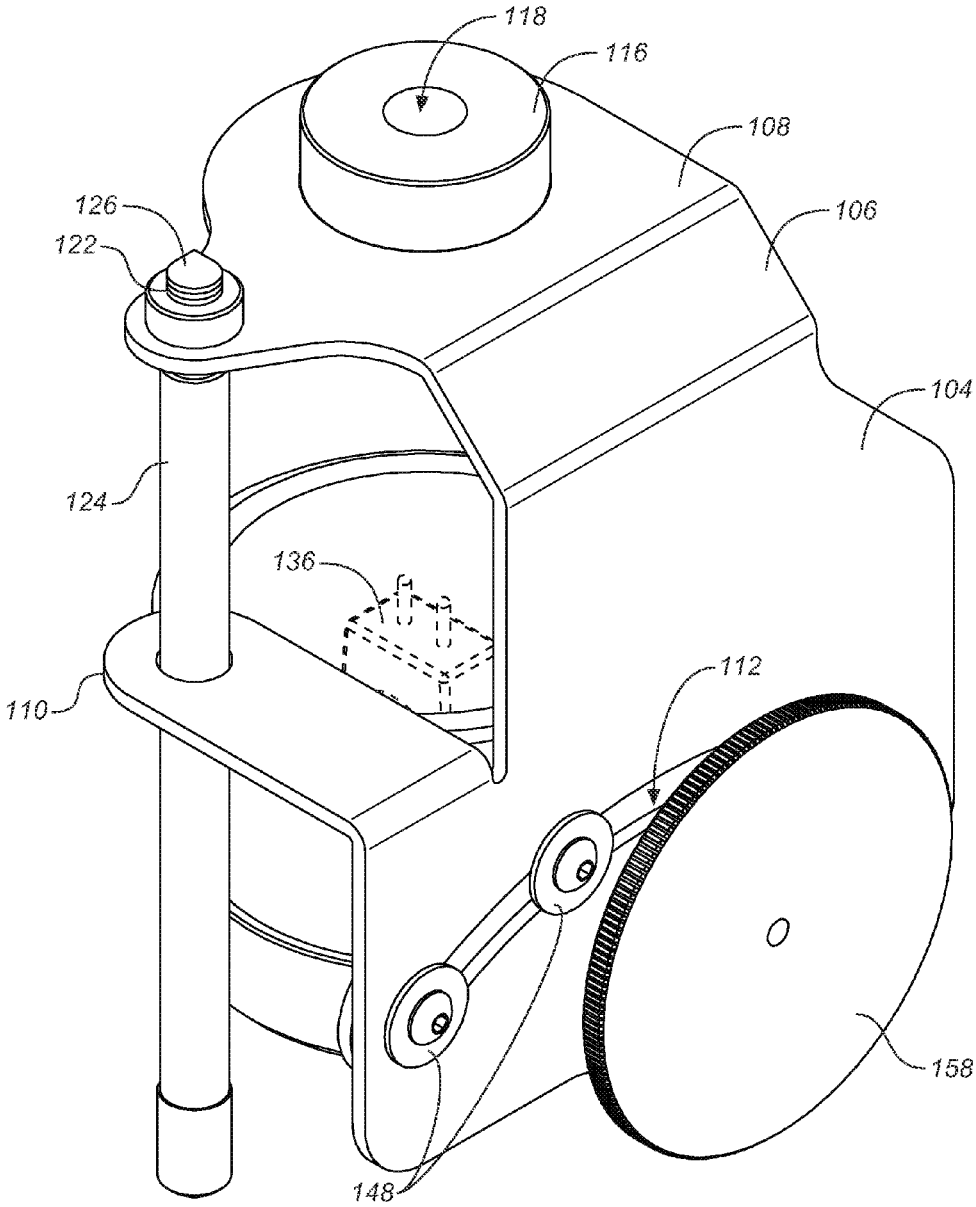
FIG. 1B is an upper left rear perspective view thereof.
Figure 1C:
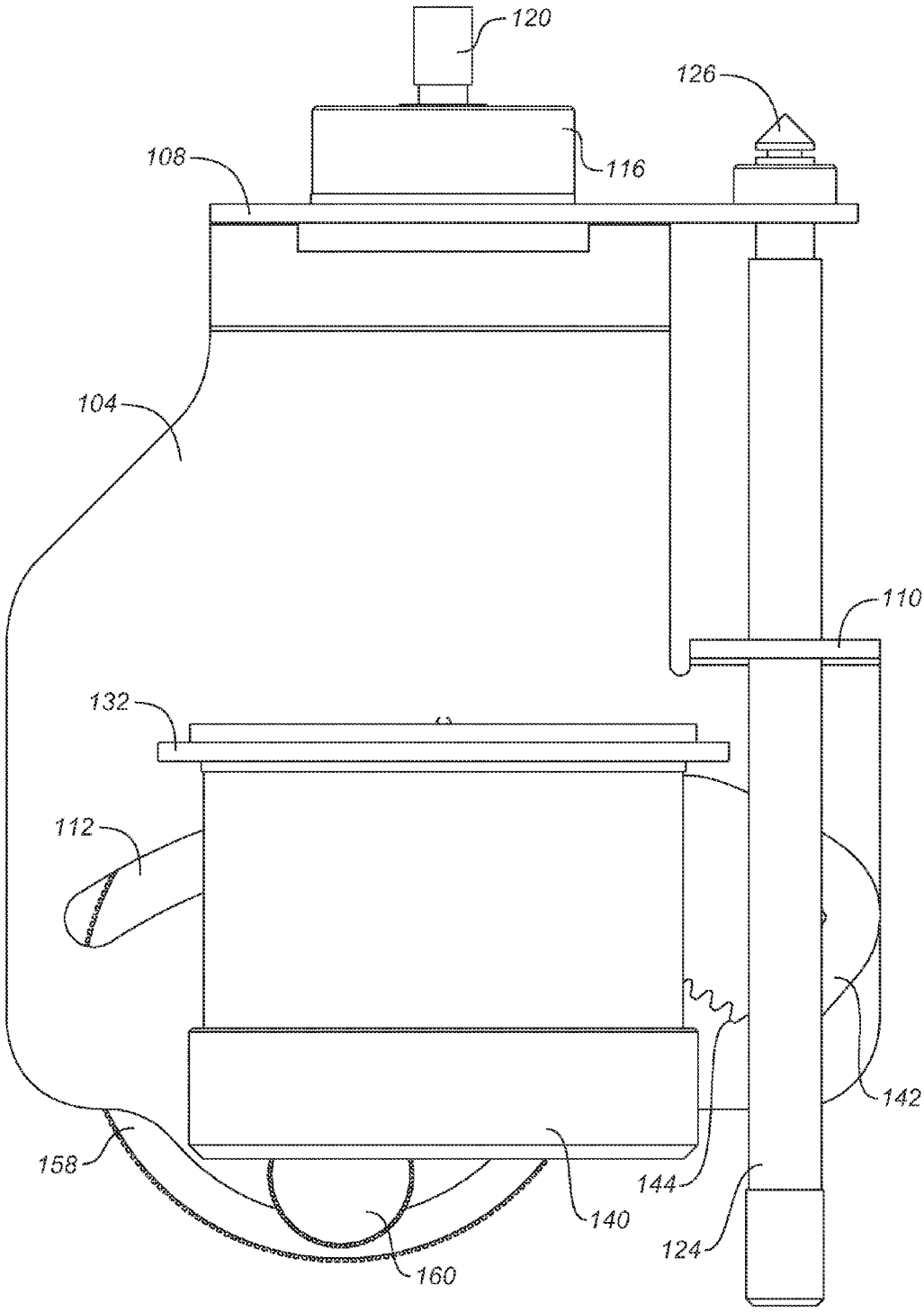
FIG. 1C is a front view in elevation thereof.
Figure 1D:
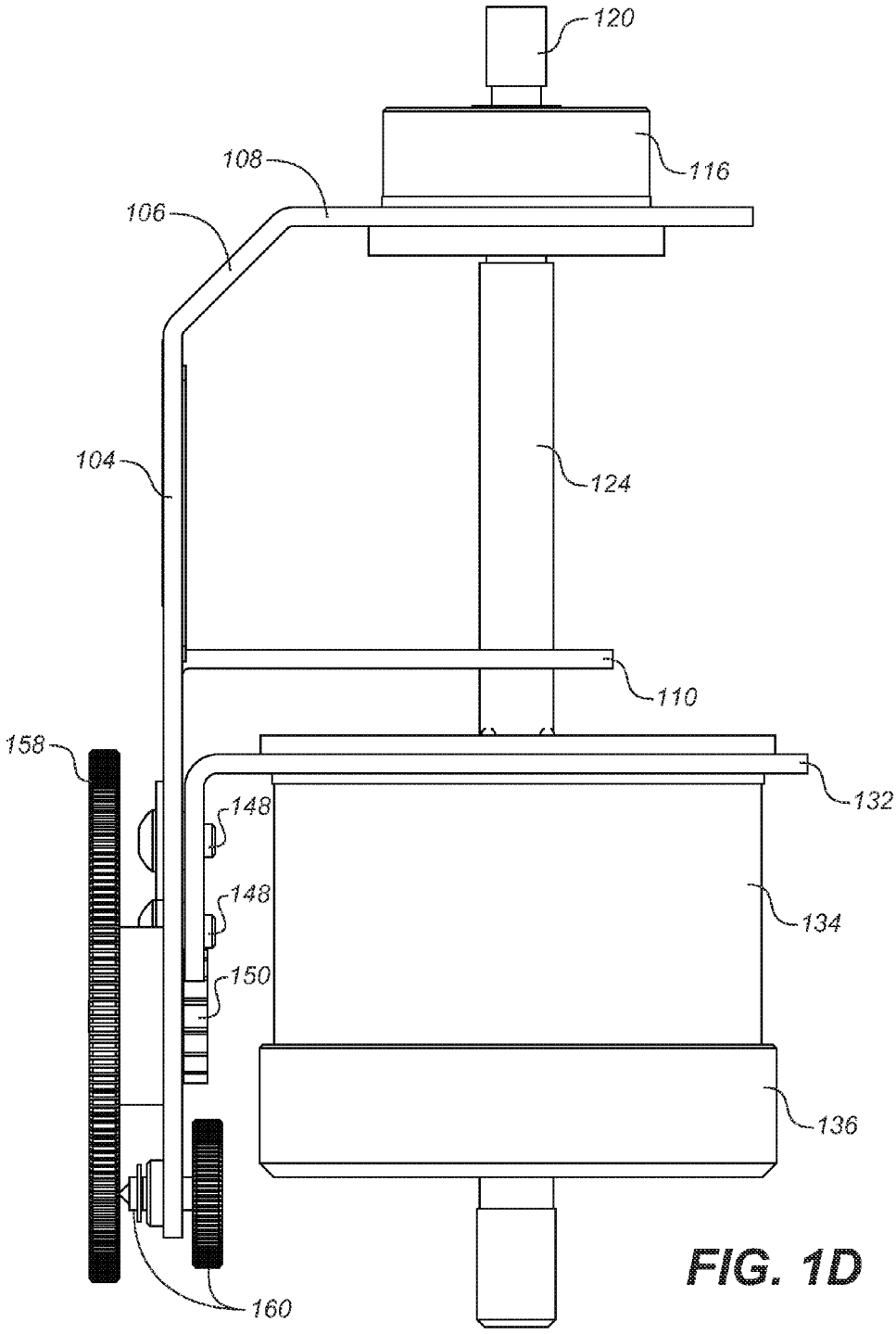
FIG. 1D is a left side view in elevation thereof.
Figure 1E:
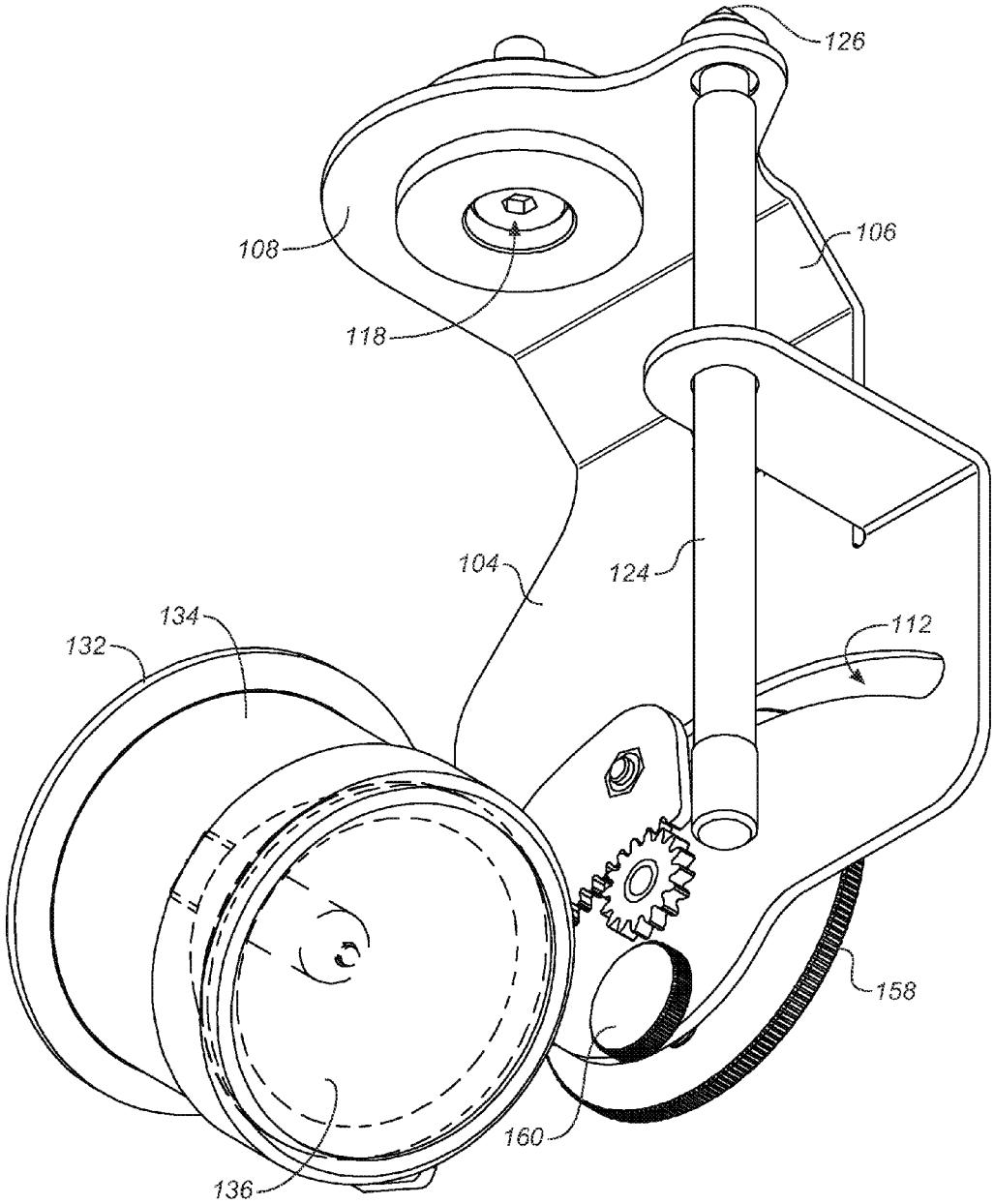
FIG. 1E is a lower left front perspective view thereof, showing a lamp tilted at an angle.
Figure 1F:
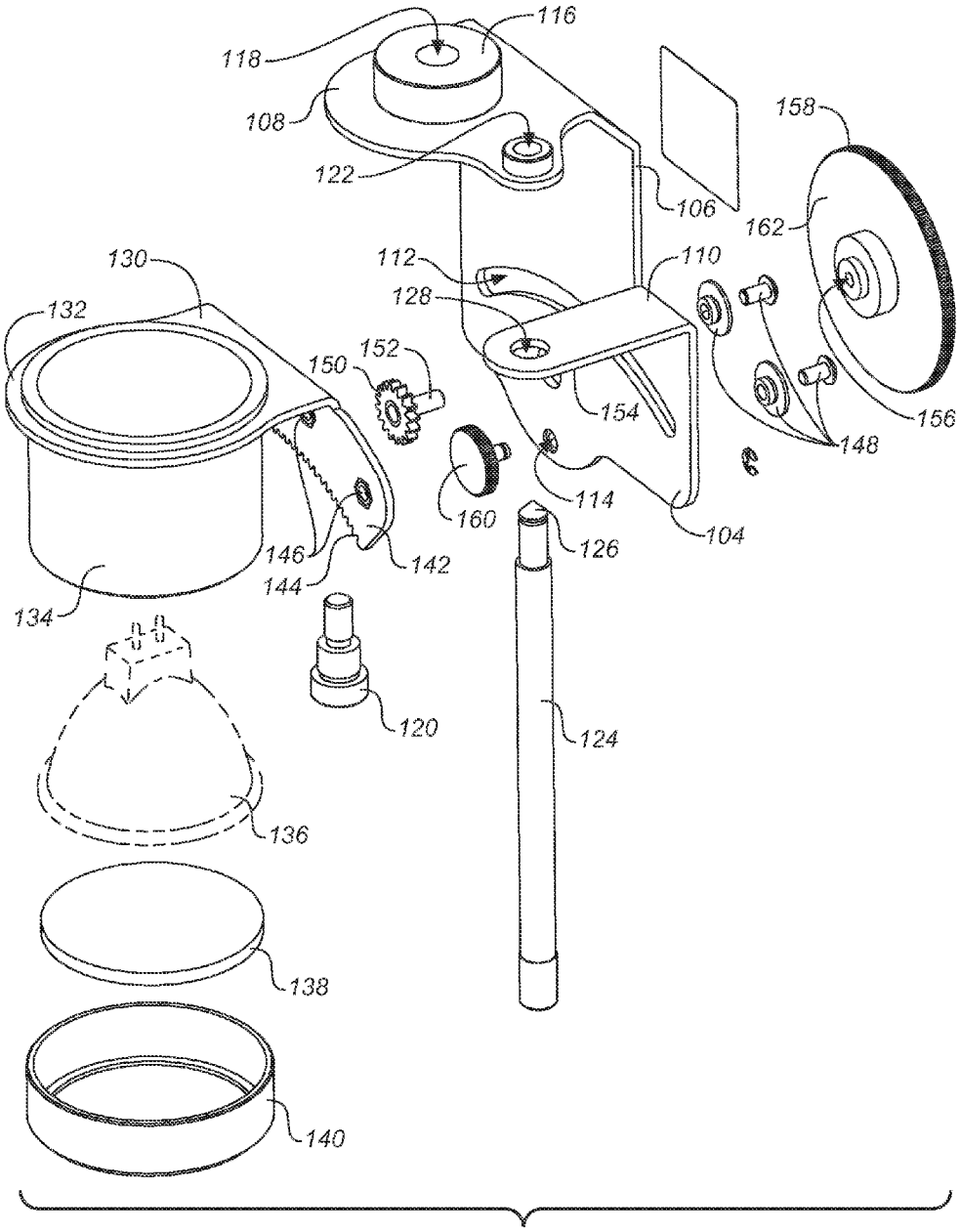
FIG. 1F is an exploded upper left perspective view of the lamp holder assembly of FIGS. 1A through 1E.

Referring to FIGS. 1 through 6, wherein like reference numerals refer to like components in the various views, there is illustrated therein a new and improved adjustable lamp holder assembly and a modular trim assembly therefor, the lamp holder assembly generally denominated 100 herein. FIGS. 1A through 1G illustrate a first preferred embodiment of the adjustable lamp holder assembly. Collectively the views show that the assembly includes a pivot bracket subassembly 102, having a vertical portion 104, an angled portion 106, an upper horizontal portion, or shoulder 108, disposed substantially normal to the vertical portion, and an arm 110 extending radially from and substantially normal to the vertical portion. The vertical portion includes, among other openings, an arcuate gear knob slot 112 and a thumb knob aperture 114.

The shoulder 108 of pivot bracket subassembly 102 includes a shoulder bolt bushing 116 which functions as a structural reinforcement for an aperture 118 used to pass a shoulder bolt 120 for rotatable insertion in a pivot hole in a fixture housing, and about which the entire assembly may be rotated for selective adjustment. The shoulder further includes a threaded lock shaft aperture 122 for threadable insertion of a male lock shaft 124, the latter having a tip 126 for engaging structure in the ceiling of a fixture housing, and which upon tightening secures the rotated position of the entire lamp holder assembly to prevent rotation when such is not desired. When the lock shaft is loosened, the lamp holder assembly may be rotated about the shoulder bolt in the plane of the fixture housing ceiling (an essentially horizontal plane). The lock shaft also passes through an arm aperture 128 in arm 110, which secures and supports the lock shaft and within which it may be freely rotated during rotatable adjustment of the lamp holder assembly.

The lamp holder assembly next includes a lamp support bracket 130 having a upper ring 132 in which a cylindrical lamp tube 134 may be integrally disposed or affixed. A lamp 136 and lens 138 or louver are secured within the lamp tube with a threaded lamp ring 140 threadably installed on the lamp tube. The lamp is connected to conducting leads in a manner well known in the art.

The lamp support bracket further includes a vertical bracket portion 142 disposed below and substantially perpendicular to the upper ring, the vertical bracket portion including an arcuate row of gear teeth 144 on its lower border. Two apertures 146 in vertical bracket portion 142 provide space for the insertion of button head cap screw and nut assemblies 148, each cap screw extending through arcuate slot 112 and for insertion into apertures 148.

Next, a spur gear 150 is disposed in mesh with the arcuate row of gear teeth 144 on the support bracket, and it includes a shaft 152 inserted through a spur gear aperture 154 in vertical portion 104 of pivot bracket assembly 102. The end of shaft 152 is rigidly fixed in a receiving hole 156 in a gear knob 158. A thumb knob 160 is threadably inserted through aperture 114 and when tightened engages the inboard side 162 of gear knob 158 so as to prevent rotation of gear knob 158 when so desired. When thumb knob 160 is sufficiently loosened, gear knob 158 may be rotated so as to rotate spur gear 150, which because of its engagement with arcuate row of gear teeth 144 also moves lamp holder bracket 130 along the length of arcuate slot 112, thus tilting the lamp holder bracket relative to the pivot support subassembly 102 in an essentially vertical plane. Thus, the combination of rotation about the horizontal plane of the fixture ceiling and the vertical plane of the vertical portion effectively provides complete light coverage options for a ceiling or wall installation.

Figure 1G:
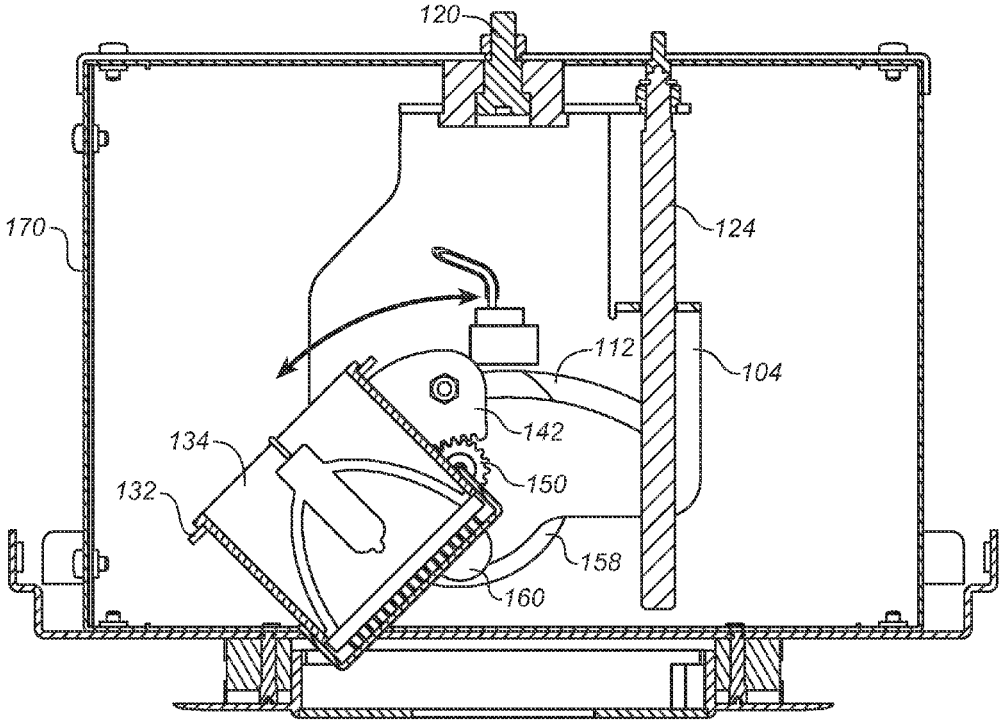
FIG. 1G is a cross-sectional front view in elevation thereof, showing the lamp holder assembly installed in a light housing box and with a trim assembly installed underneath.

Referring specifically to FIG. 1G, it will be seen that the lamp holder assembly is rotatably installed in a fixture housing 170 using the shoulder bolt 120 and is selectively prevented from rotation or selectively allowed to rotate by tightening or loosening lock shaft 124.

Figure 2A:
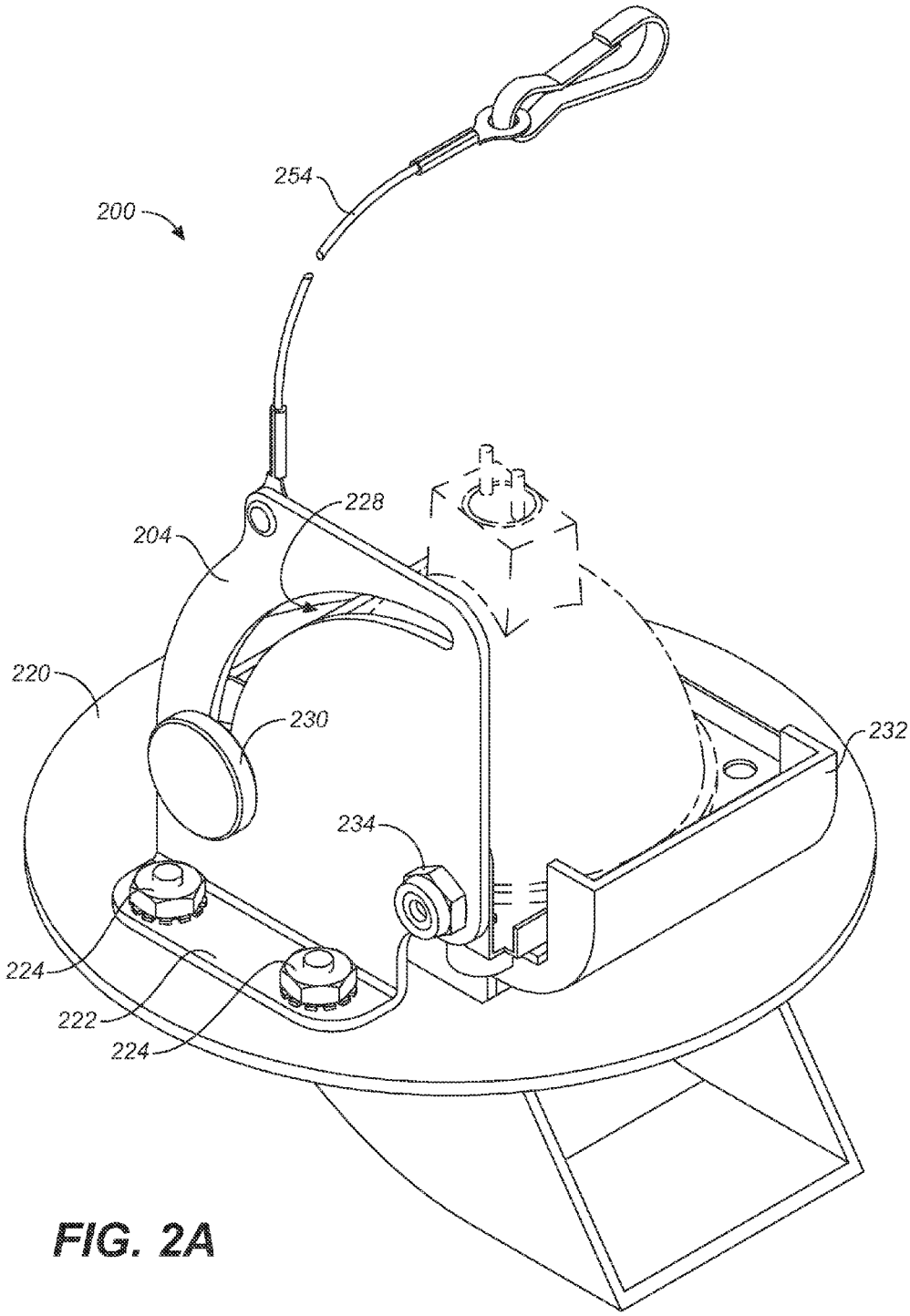
FIG. 2A is an upper right perspective view showing an alternative embodiment of the lamp holder assembly of the present invention, including a mirror subassembly.
Figure 2B:
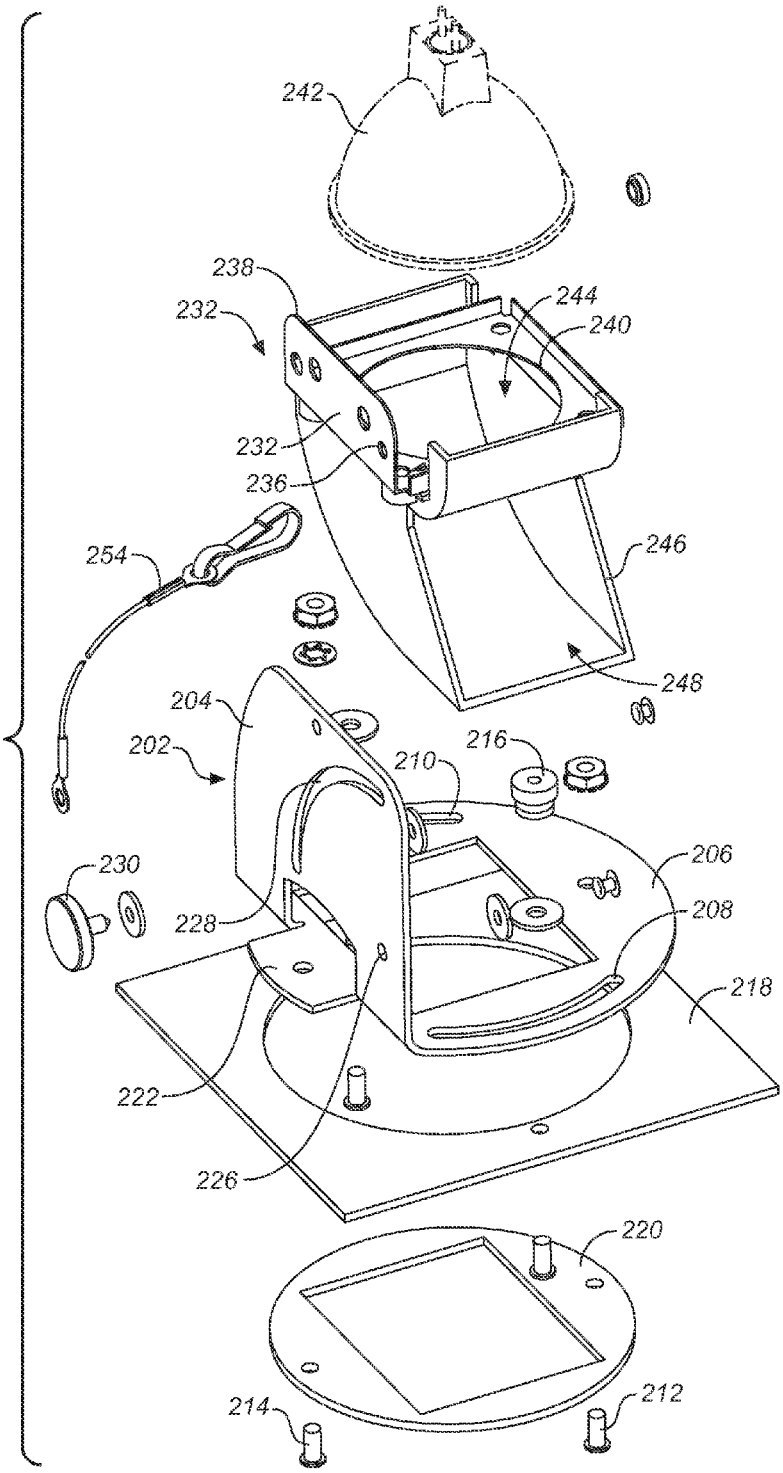
FIG. 2B is an upper right exploded view thereof, also including two kinds of trim plate suitable for installations.
Figure 2C:
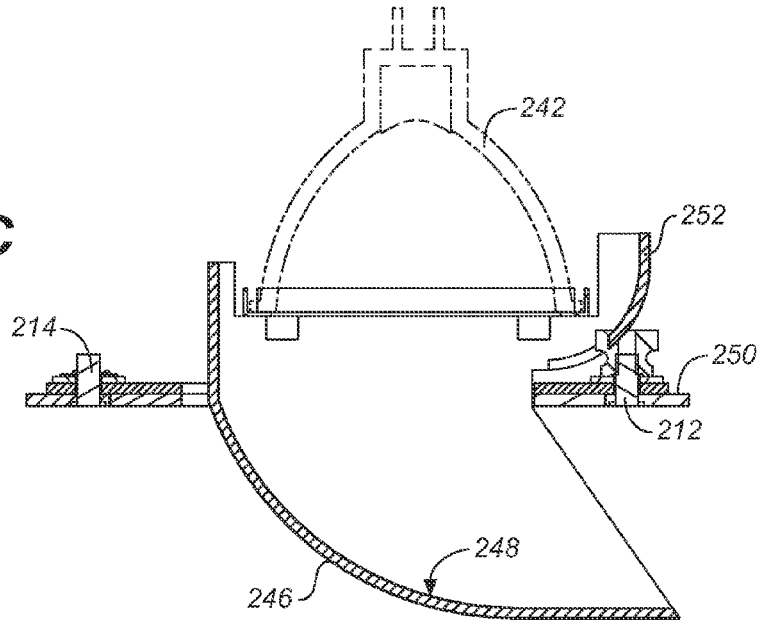
FIG. 2C is a cross-sectional side view in elevation showing the lamp adjustment assembly and mirror subassembly in a fully extended configuration.
Figure 2D:
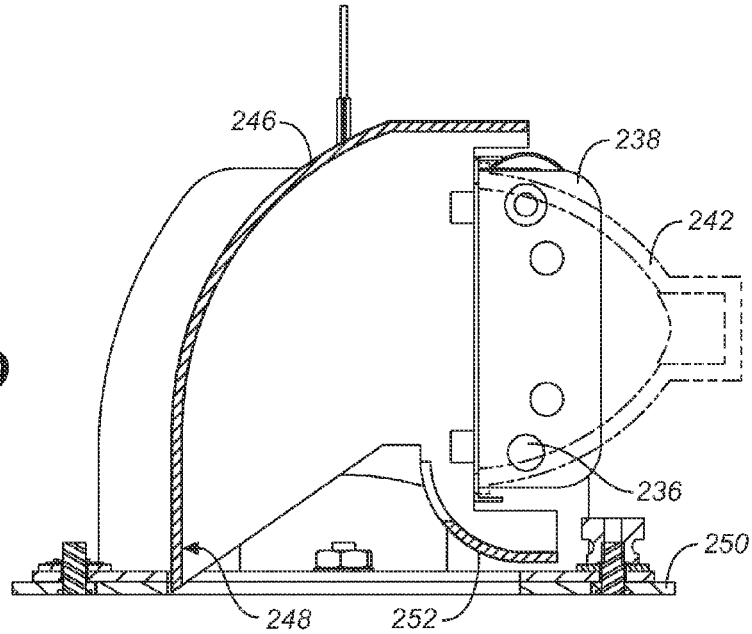
FIG. 2D is a cross-sectional side view in elevation showing the lamp adjustment assembly and mirror subassembly fully retracted.

Referring next to FIGS. 2A through 2C, in a second preferred embodiment 200, the lamp holder assembly of the present invention comprises a support bracket 202 having a vertical plate 204 and a horizontal plate 206. The latter includes two arcuate slots 208, 210, through which posts 212, 214 are disposed and around which the support bracket may be rotated. A locking nut 216 may be threadably disposed on either post or on a third post to secure the support bracket and prevent unwanted rotation.

The support bracket 202 is mounted to either a square or a circular mounting plate 218, 220, respectively, using a tab 222 extending radially outwardly from the vertical plate 204 and providing either one (FIG. 2B) or two apertures (FIG. 2A) for installation of fastener assemblies 224.

The vertical plate 204 includes a pivot hole 226 and an arcuate slot 228, the latter through which an adjustment knob 230 is disposed.

Next, a lamp holder 232 is pivotally connected to support bracket 202 using a rivet and rivet head assembly 234 matably inserted through pivot hole 226 and pivot hole 236 disposed in a vertical portion 238 of lamp holder 232 and further using adjustment knob 230. When adjustment knob 230 is sufficiently loosened, lamp holder 232 may be tilted relative to support bracket 202.

Lamp holder 232 further includes a base portion 240 onto which a lamp 242 may be mounted, and base portion 240 includes an opening 244 suited to the shape and size of the lamp of intended use. When so mounted, the lamp shines outwardly through opening 244 into a trough or shovel-shaped mirror 246 having a specular interior surface 248. Accordingly, when fully extended (FIG. 2C), the light from lamp 242 shines generally parallel to the surface 250 in which the assembly is mounted. When fully retracted (FIG. 2D), the light shines generally perpendicular to the surface. An arcuate light shield 252 prevents unwanted interfering light rays. Finally, leash 254 is connected to a fixture housing to prevent the assembly from dropping during adjustment.

In this manner, a lamp holder fixture is provided that allows for full rotation combined with a wide range of tilting adjustments such that the direction of light emanating from a lamp installed in a recessed light housing may be tightly tailored to the aesthetic preferences of the user.

Figure 3A:
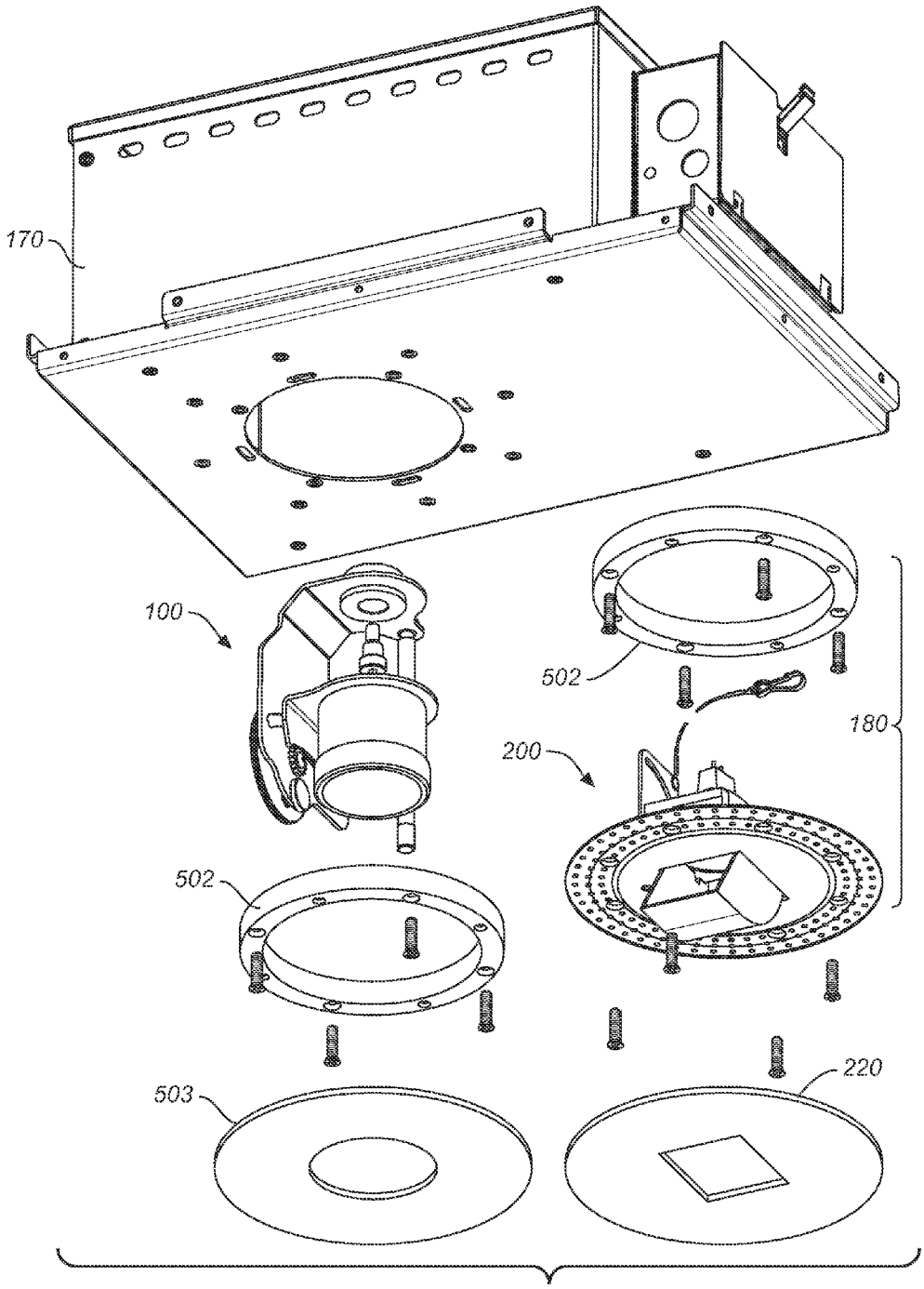
FIG. 3A is a lower right exploded perspective view showing the lamp holder assemblies of FIGS. 1A through 1G and 2A through 2D, each poised for installation in a lamp holder box, and further showing a square embodiments of the modular trim assembly of the present invention.
Figure 3B:
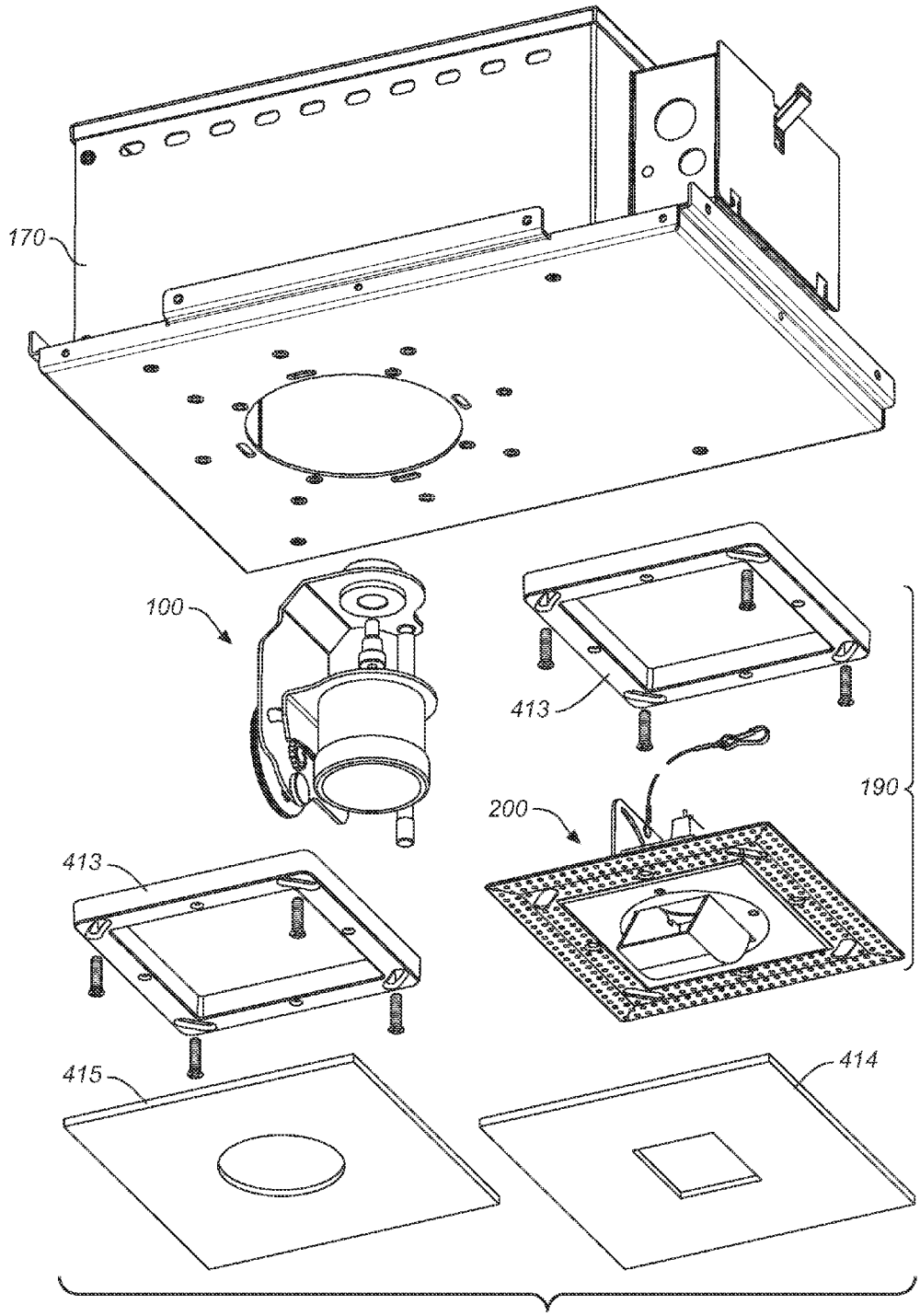
FIG. 3B is the same view as that of FIG. 3A, but showing a circular embodiment of the modular trim assembly.

Referring next to FIGS. 3A and 3B, there is shown the general elements of an installation in a fixture housing 170 of either adjustable lamp holder assembly 100 or 200, using either a circular trim assembly 180 (FIG. 3A) or a square trim assembly 190 (FIG. 3B).

Figure 4:
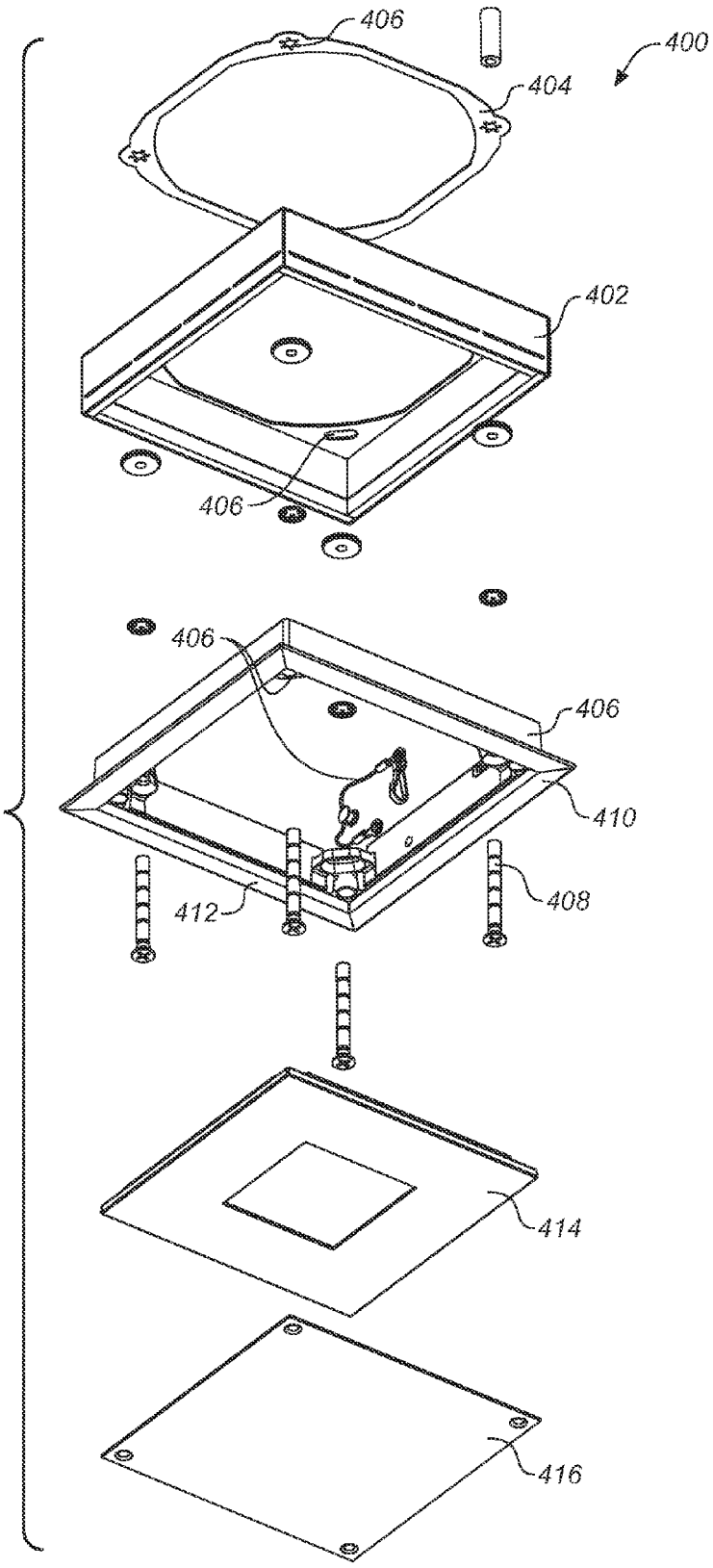
FIG. 4 is a lower exploded perspective view of the flanged, square, flush mounted embodiment of the modular trim assembly of the present invention.
Figure 5A:
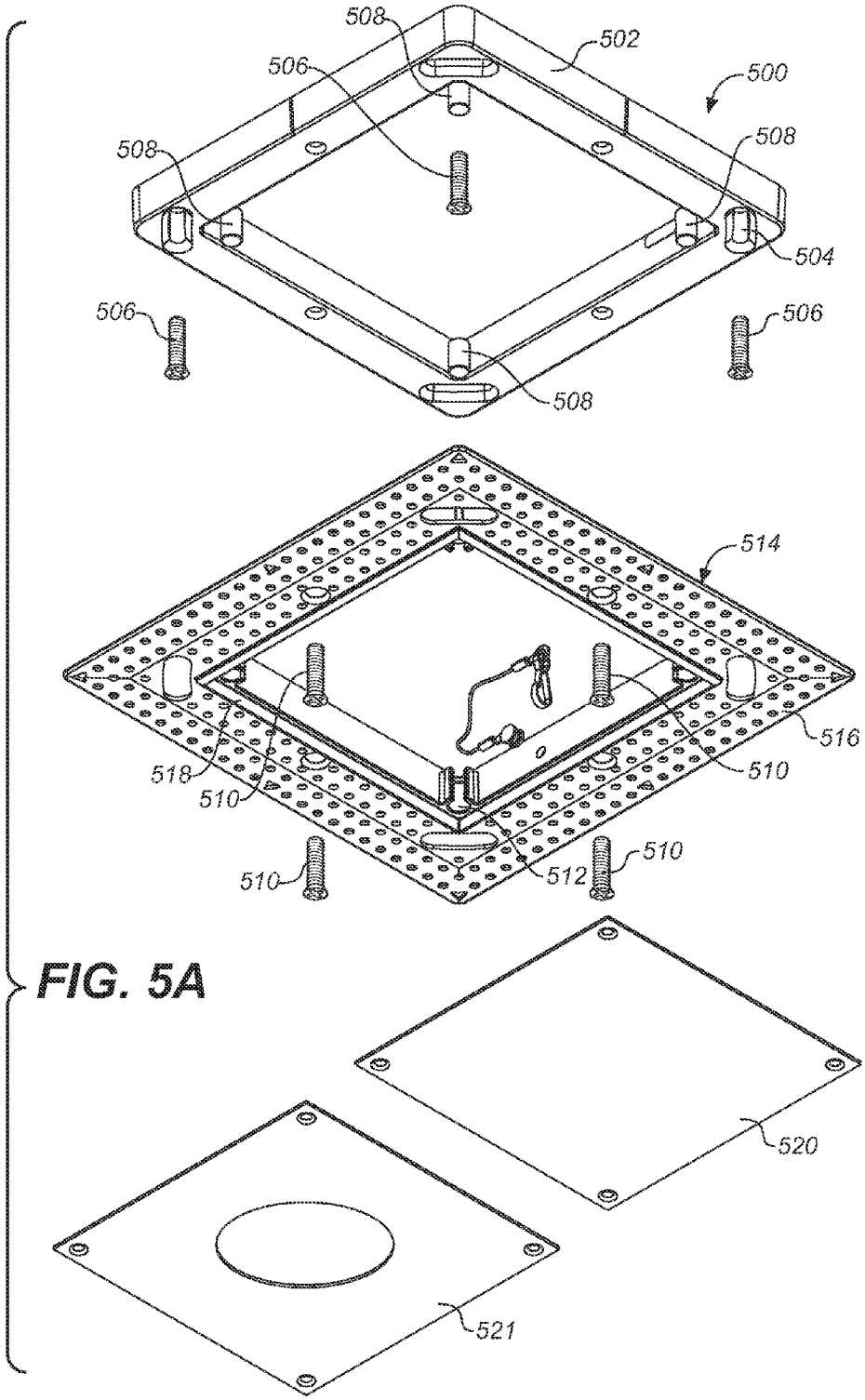
Figure 5B:
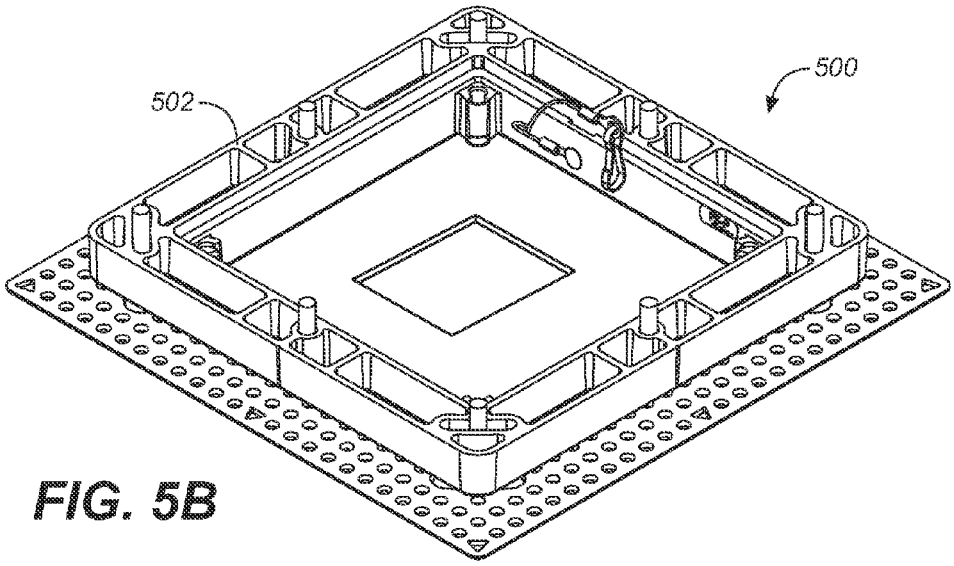
FIGS. 5B and 5C are upper and lower perspective views thereof.
Figure 5C:
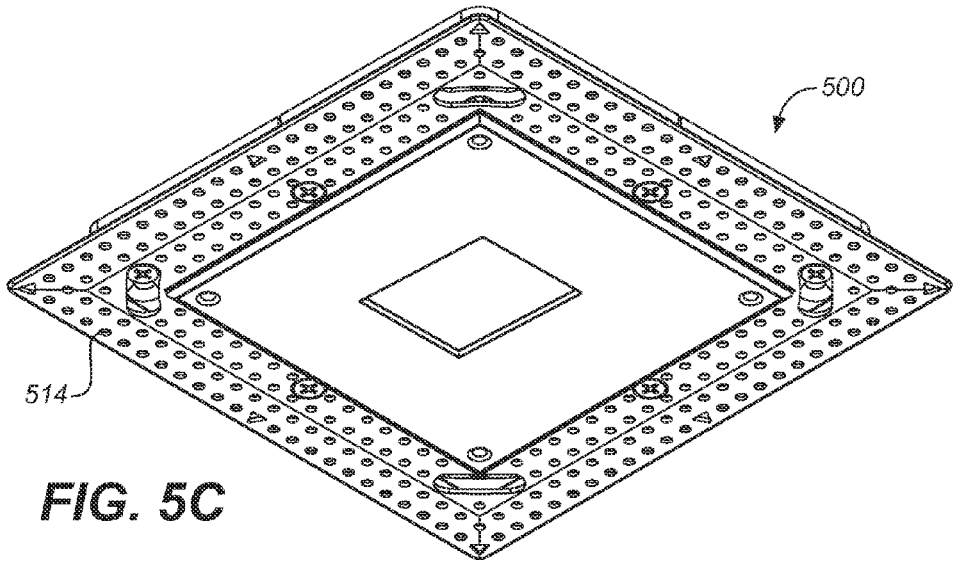
Figure 6:
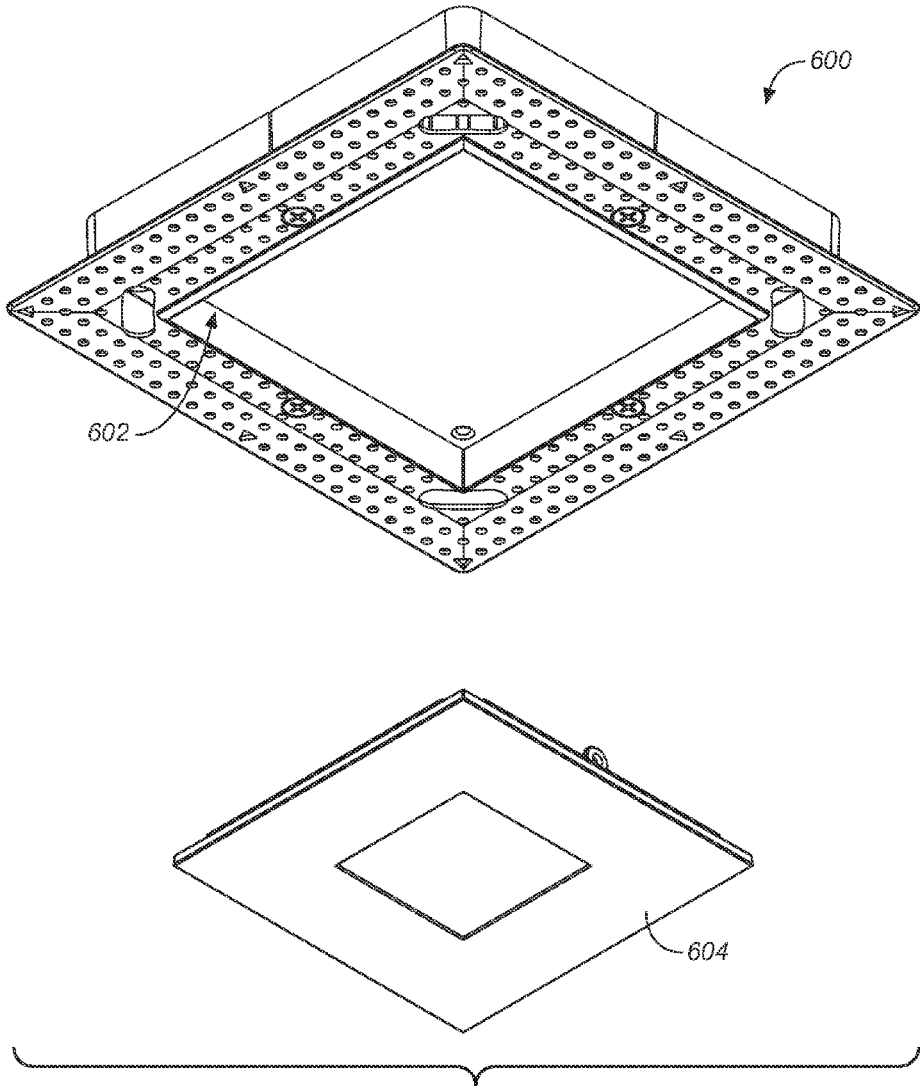
FIG. 6 is a lower perspective showing an alternative embodiment having an inset for a trim plate.

Referring now to FIGS. 4 through 6, there is shown the structural and functional elements of the modular trim assembly adapted for use with the lamp holder assemblies of the present invention. FIG. 4 shows a square and flush trim assembly 400 having a flange adapted for installation in wood or other finished surfaces that do not employ setting material or a trim flange. The assembly thus includes a light shield 402 and gasket 404 into which a trim piece 404 is inserted. Each piece has a plurality of aligned holes 406 for insertion of fasteners 408 for attaching the assembly to a light fixture housing (170 in FIGS. 3A and 3B). The trim piece includes a flange 410 which provides an aesthetic finish for installations when finishing compound is not employed to create a flush look between the trim assembly and structure surface. The trim piece includes magnets (not shown) disposed entirely or partly around its periphery in a trim plate frame 412 for holding a trim plate 414 after installation is complete. A dust cover 416 may be employed to prevent contamination during construction.

FIGS. 5A through 5C show a square and flush trim assembly 500 adapted for use when setting compound, such as plaster is used for creating a flush look with the structural surface. The assembly includes a die cast base 502 having arcuate mounting holes 504 for passing mounting bolts 506 for attaching the assembly to a housing. The base further includes threaded holes 508 for insertion of trim assembly bolts 510 passed through complementary holes or supports 512 disposed on the interior side (preferably the interior corners) of a trim and magnet assembly 514. The trim and magnet assembly includes a perforated flange 516 which is generally planar to the structural surface of the wall or ceiling into which a light housing is mounted, and which is given a flush appearance through the use of setting compound, in a manner well known in the art. A magnetic frame rim 518 may include a plurality of magnets that may be disposed proximate to or in the rim to provide a base for securing a ferromagnetic trim plate or a dust cover 520.

Unlike trim assemblies in current use, the trim assembly of the present invention includes a novel system for adjusting the spacing of the trim and magnet assembly, and thus the perforated flange, relative to the die cast base, thus enabling fine adjustment of the perforated flange in relation to the surface of the structure in which it is to be installed. This significantly simplifies finishing procedures and ensures a much better appearance on completion. Additionally, in the square embodiments of the trim assembly, because the mounting holes 504 in the base are arcuate, the trim and magnet assembly can be rotated relative to the die cast base because the mounting holes are arcuate. Thus, the alignment of the sides of the trim assembly can be finely adjusted to create a square appearance, which is challenging to accomplish in the invariably imperfect world of rough construction. [See, for instance, elements 504 and 514 of FIG. 5.] While rotation of up to 5° appears to sufficient for most purposes, even greater adjustability can be provided by including a larger arc in the mounting holes.

FIG. 6 shows an alternative embodiment, which includes elements identical to those of the embodiment shown in FIGS. 5A through 5C, with the exception that the frame rim 602 is inset, such that a trim plate 602 is inset a distance that provides an aesthetically pleasing appearance.

As will be readily appreciated by those with skill in the relevant art, the square shape of the described embodiments is for purposes of illustration only. While the structural elements would remain the same, the shape of the inventive trim assembly could be altered to comprise circular shapes or any of a number of polygonal shapes, at the whim and desire of the designer, all without changing the inventive aspects of the present invention.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A recessed lighting unit, comprising:

an adjustable lamp holder assembly;

a fixture housing within which said adjustable lamp holder assembly is mounted; and a modular trim assembly;

wherein said adjustable lamp holder assembly includes a pivot bracket having a vertical portion, an angled portion, an upper horizontal portion disposed substantially normal to said vertical portion, and an arm extending radially from and substantially normal to said vertical portion, said vertical portion including an arcuate gear knob slot and a thumb knob aperture; a shoulder bolt disposed through said shoulder for rotatable insertion in a pivot hole in said fixture housing, and about which said lamp holder assembly may be rotated for selective adjustment; a lamp support bracket having a upper ring in which a lamp tube may be disposed; a vertical bracket portion disposed below and substantially perpendicular to said upper ring, said vertical bracket portion including an arcuate row of gear teeth proximate its lower border and two apertures that provide space for the insertion of a screw through said arcuate gear knob slot; a spur gear disposed in mesh with said arcuate row of gear teeth on said support bracket, said spur gear including a shaft inserted through a spur gear aperture in said vertical portion of said pivot bracket assembly, the end of said shaft being rigidly fixed in a receiving hole in a gear knob; a thumb knob threadably inserted through the aperture in said vertical portion, such that when tightened engages gear knob so as to selectively prevent rotation of said gear knob, and which when said thumb knob is sufficiently loosened, said gear knob may be rotated to rotate spur gear, and through operative engagement with said arcuate row of gear teeth also moves said lamp holder bracket along the length of said arcuate gear knob slot, thus tilting said lamp holder racket relative to said pivot support; and wherein said modular trim assembly includes a light shield and gasket into which a trim piece is inserted, each trim piece having a plurality of aligned holes for insertion of fasteners for attaching said modular trim assembly to said fixture housing and including magnets disposed around its periphery in a trim plate frame for holding a trim plate.

2. The apparatus of claim 1, wherein said shoulder further includes a threaded lock shaft aperture for threadable insertion of a male lock shaft having a tip for engaging the ceiling of said fixture housing, and which upon tightening secures the rotated position of said lamp holder assembly to selectively prevent rotation, and which, upon loosening said lamp holder assembly may be rotated about said shoulder bolt.

3. The apparatus of claim 2, wherein said lock shaft passes through an aperture in said arm.

4. The apparatus of claim 1, wherein said modular trim assembly further includes a flange for an aesthetic finish in installations when finishing compound is not employed.

* * * * *